US007168387B1

(12) United States Patent
Al-Garni et al.

(10) Patent No.: US 7,168,387 B1
(45) Date of Patent: Jan. 30, 2007

(54) SUBMERSIBLE CRAFT FOR WATER PURIFICATION

(75) Inventors: Ahmed Al-Garni, Dhahran (SA); Farooq Saeed, Dhahran (SA); Adnan Al-Asaly, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 11/339,509

(22) Filed: Jan. 26, 2006

(51) Int. Cl.
*B63G 8/00* (2006.01)

(52) U.S. Cl. ..... 114/312

(58) Field of Classification Search ..... 114/312, 114/315

See application file for complete search history.

(56) References Cited

U.S. PATENT DOCUMENTS

| | | | | |
|---|---|---|---|---|
| 4,108,775 | A | 8/1978 | Wilkes | |
| 4,118,994 | A | 10/1978 | Layotte | |
| 4,145,290 | A * | 3/1979 | Nagy et al. | 210/242.3 |
| 4,279,757 | A | 7/1981 | DeBeuckelaer | |
| 4,357,764 | A | 11/1982 | Lemercier | |
| 4,454,035 | A | 6/1984 | Stefan | |
| 4,533,526 | A | 8/1985 | Delacour | |
| 4,545,905 | A | 10/1985 | Poe | |
| 4,734,205 | A | 3/1988 | Jacques | |
| 5,196,119 | A | 3/1993 | Harms | |
| 5,232,085 | A | 8/1993 | Hayashi | |
| 5,268,150 | A | 12/1993 | Burkitt | |
| 5,373,703 | A | 12/1994 | Pal | |
| 5,376,027 | A * | 12/1994 | Hergenrather | 440/38 |
| 5,413,717 | A | 5/1995 | Webster | |
| 5,478,483 | A | 12/1995 | Gore | |
| 5,531,902 | A | 7/1996 | Gallup | |
| 5,614,100 | A | 3/1997 | Gallup | |
| 5,616,814 | A | 4/1997 | Preston | |
| 5,798,046 | A | 8/1998 | Greer | |
| 6,112,538 | A | 9/2000 | Strussion | |
| 6,197,206 | B1 | 3/2001 | Wasinger | |
| 6,293,121 | B1 | 9/2001 | Labrador | |
| 6,365,397 | B1 | 4/2002 | Salanitro | |
| 6,372,472 | B1 | 4/2002 | Nehls | |
| 6,458,276 | B1 | 10/2002 | Byers | |
| 6,485,546 | B2 | 11/2002 | Fuchs | |
| 6,539,738 | B2 | 4/2003 | Gonzalez-Cruz | |
| 6,595,020 | B2 | 7/2003 | Sanford | |

(Continued)

FOREIGN PATENT DOCUMENTS

| | | |
|---|---|---|
| GB | 2061752 | 5/1981 |

(Continued)

*Primary Examiner*—Stephen Avila
(74) *Attorney, Agent, or Firm*—Richard C. Litman

(57) ABSTRACT

A submersible craft for water purification is provided. The submersible craft includes an annular hollow housing which contains a plurality of guide vanes for directing water flow through the housing when the submersible craft is submersed in a body of water and also a plurality of filters for filtering contaminants from the water. The craft includes a drive system and a navigation system for allowing a user control over thrust, depth and navigation through the body of water. Both the drive system and navigation system may be remote controlled by the user, or controlled by a pre-programmed guidance system mounted within the hollow housing. The submersible craft is powered by rechargeable batteries, which may be recharged by solar panels mounted on the craft, in order to minimize pollutants generated by the on-board systems of the craft.

17 Claims, 9 Drawing Sheets

U.S. PATENT DOCUMENTS

| | | | | |
|---|---|---|---|---|
| 6,598,554 | B1 | 7/2003 | Lasky | |
| 6,662,742 | B2 * | 12/2003 | Shelton et al. | 114/312 |
| 6,790,345 | B2 | 9/2004 | Broussard | |
| 2004/0182766 | A1 * | 9/2004 | Kelty | 210/169 |

FOREIGN PATENT DOCUMENTS

| | | |
|---|---|---|
| WO | WO87/06556 | 11/1987 |
| WO | WO89/10296 | 11/1989 |

* cited by examiner

SUBMERSIBLE CRAFT FOR WATER PURIFICATION

BACKGROUND OF THE INVENTION

1. Field of the Invention

The present invention is directed to a submersible craft for the purification of water. Particularly, the submersible craft has a buoyant hollow housing for controlled submersion in a body of water. More particularly, the hollow housing receives a plurality of guide vanes for directing water through the housing and a plurality of filter elements for filtering contaminants out of the water which passes through the hollow housing as the craft navigates through the fluid medium.

2. Description of the Related Art

A wide variety of water purification systems have been utilized to remove contaminants and pollutants from both man-made and natural bodies of water. However, such systems are either typically water skimmers, which can only collect oils having a density less than that of water, residing on the surface of the water, or must remain stationary with respect to a fixed point. Neither type of system is effective for collection, filtering and monitoring of water containing a variety of either known or unknown contaminants.

Water skimmers tend to be only effective at removing oils with densities lower than the density of water; i.e., oils which float on the surface of the water. The water skimmers cannot remove other types of contaminants and pollutants, namely, impurities which reside beneath the surface of the water, and may take the form of high density oils or particulate matter.

Water purification systems which are submersible have been utilized for filtering water below the surface. Such purification systems, however, are typically stationary, both in the area covered and in the depth of the water. As with prior water skimmers, the submersible water purification systems tend to be only effective at removing one type of contaminant found at a single depth in a highly localized area. Further, moving such a system requires external sources of power and locomotion, such as a crane or the construction of a separate propulsion system. Additionally, such systems must be powered by an external power source, which is both energy inefficient, but also inconvenient, given that large sources of power are rarely convenient to bodies of water.

It would be desirable to provide a submersible craft which relies on the natural buoyancy of the materials used in its construction and gravity in order to control depth, thus reducing power consumption. Additionally, it would be further desirable to provide solar panels, which may be utilized for recharging submarine-carried batteries, further reducing power consumption and production of pollutants.

None of the above inventions, taken either singly or in combination, is seen to describe the instant invention as claimed. Thus, a submersible craft for water purification solving the aforementioned problems is desired.

SUMMARY OF THE INVENTION

A submersible craft for water purification is provided. The submersible craft includes an annular hollow housing which contains a plurality of guide vanes for directing water flow through the housing when the craft is submersed in a body of water, and a plurality of filters for filtering contaminants from the water. The craft includes a drive system and a navigational system for allowing a user control over thrust, depth and navigation through the body of water. The submersible water filtration system may be remote controlled or may be controlled by an onboard guidance system. Further, water monitoring sensors may be mounted on the craft for monitoring of water conditions as the craft navigates through the body of water.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
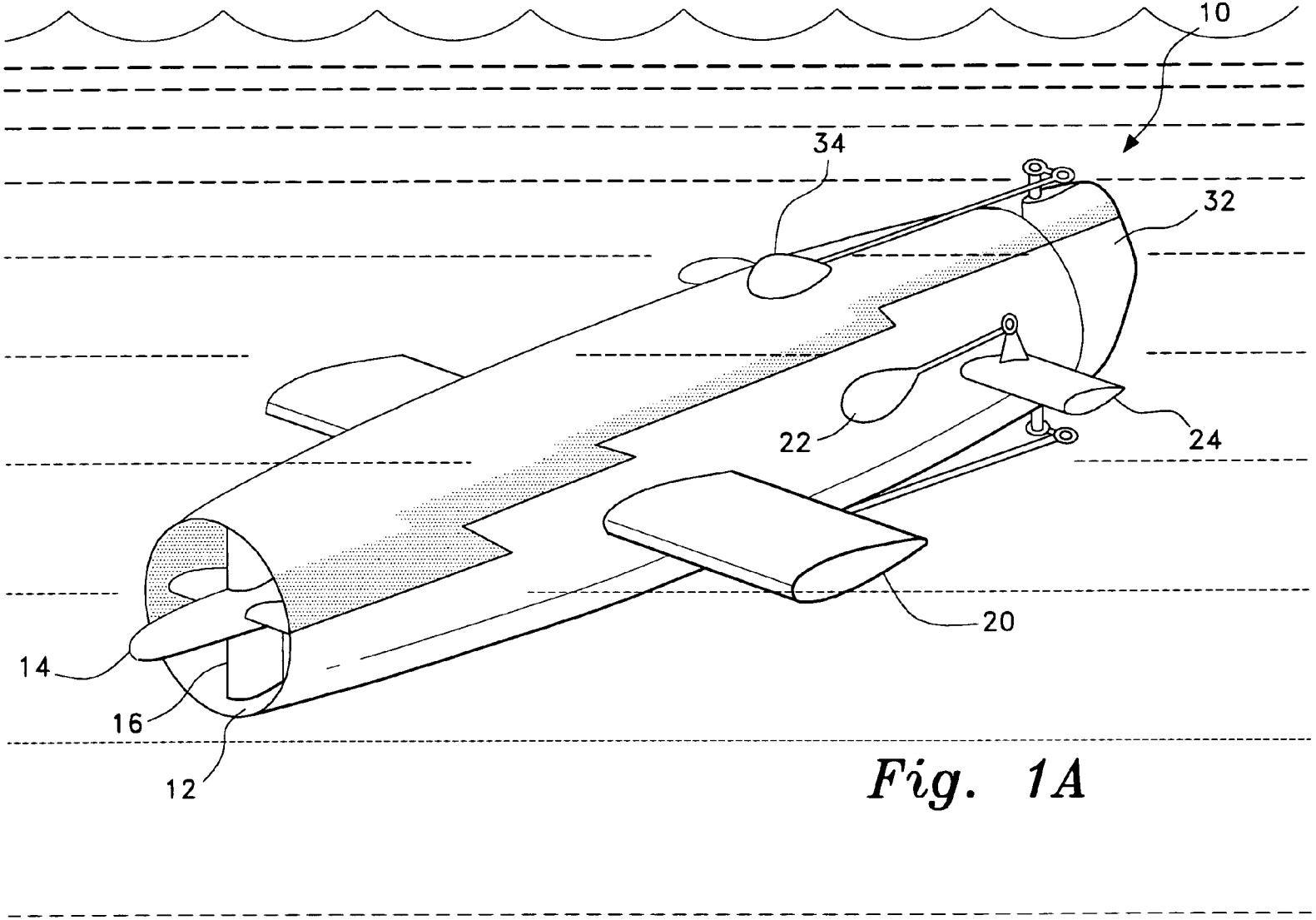
FIG. 1A shows a perspective environmental view of the subject submersible craft for water purification.
Figure 1B:
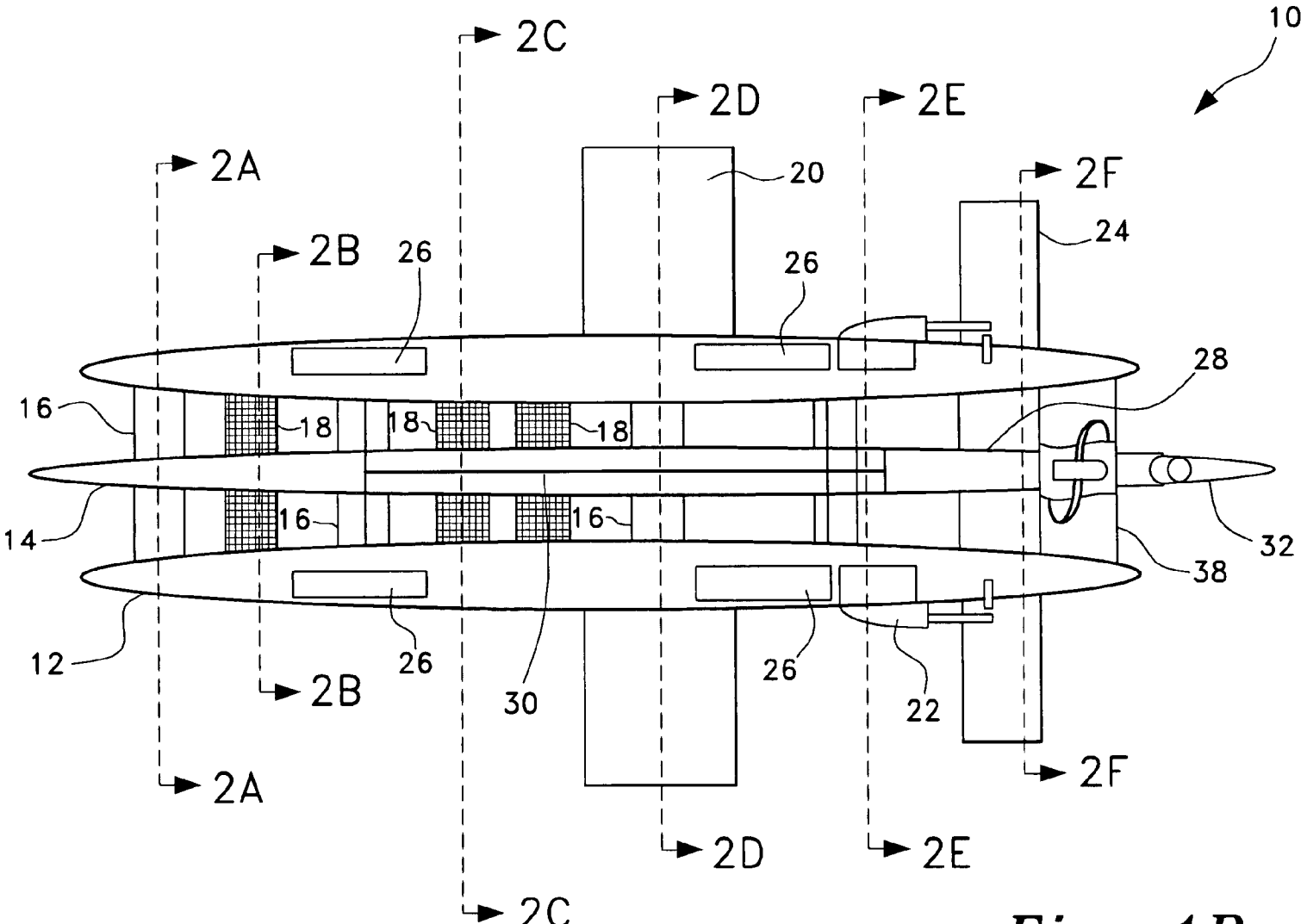
FIG. 1B shows a top cut-away view of the subject submersible craft for water purification.
Figure 3:
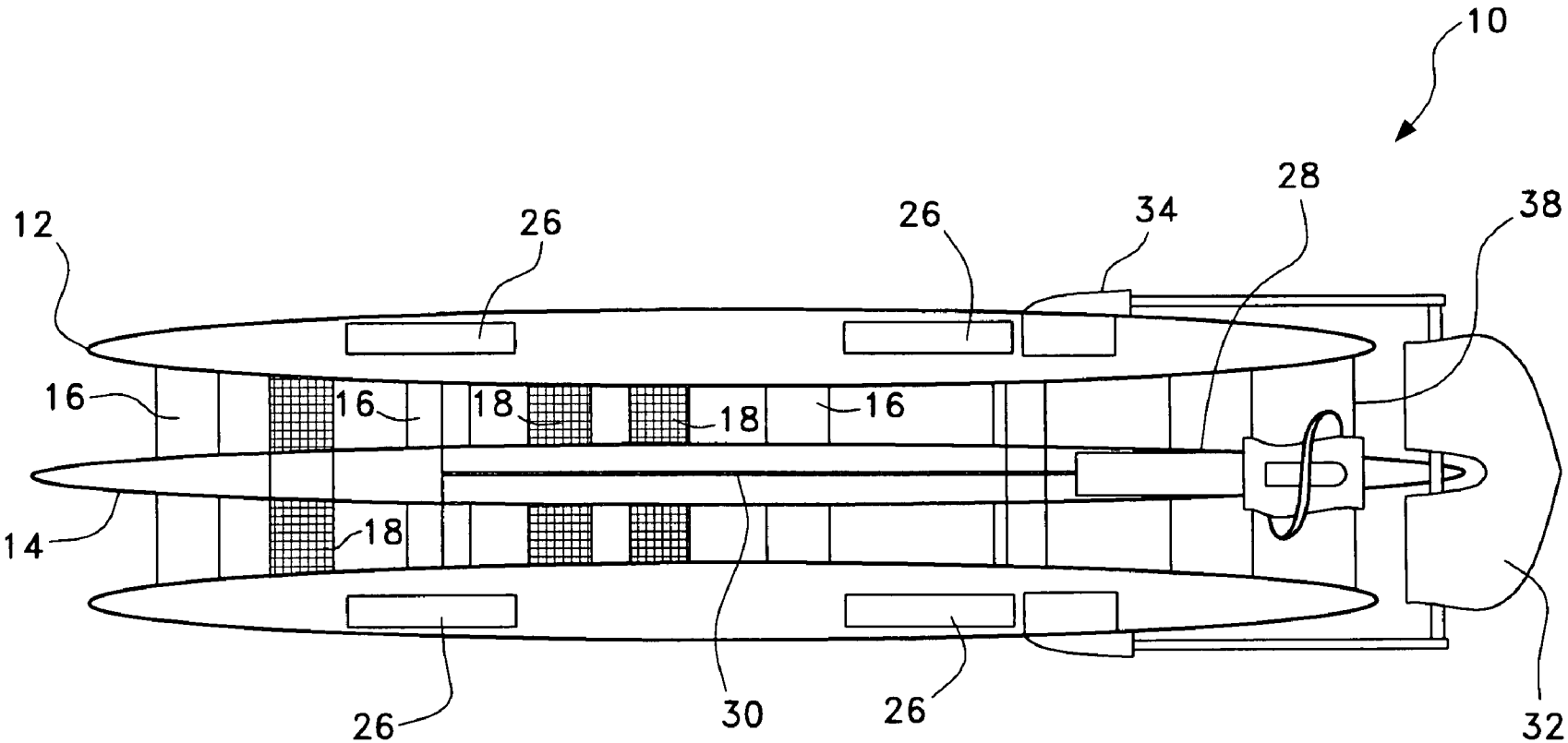
FIG. 3 shows a diagrammatic sectional view of the subject submersible craft for water purification.

Referring now to FIGS. 1A, 1B and 3, there is shown a first embodiment of a submersible craft 10 designed for the purification of water or other fluid media. Submarine 10 may be used to remove contaminants from water supplies. The submersible craft may be placed in a body of water, such as a lake or an ocean, for example, and may further be used to either skim contaminants from the surface of the body of water or the craft 10 may be fully submerged to filter contaminants at a depth below the water level. The submersible craft is either remote controlled or controlled by an on-board navigational guidance system, allowing the craft 10 to patrol a selected area of the body of water.

As best shown in the top-view of FIG. 1B and the side view of FIG. 3, the submersible craft 10 includes a main hollow body member 12, elongated and extending in a longitudinal direction. Though the hollow body member 12 may have any desired cross-sectional contour, it is preferable that the body have a substantially annular cross-sectional contour, as shown in FIGS. 2A–2F, which allows for efficient passage of water through the interior of body member 12 with a minimum of vortices and other undesirable fluid currents. Main body member 12 is preferably constructed from a buoyant material. The annular cross-section of hollow body 12 forms a convergent-divergent duct, thus increasing the rate at which fluid passes through the interior of body 12.

An inner core member 14 is received within the interior of hollow body 12. The inner core member 14 is elongated and projects along the longitudinal axis of hollow body 12, as shown in FIGS. 1B and 3. Further, as shown in FIGS. 1A, 1B and 3, the leading edges of the hollow body 12 and the core member 14 are smooth and tapered in order to reduce drag as the craft 10 moves through water and also to maximize the amount of fluid passing through the interior of hollow body 12.

A plurality of guide vanes 16 are provided in the interior of hollow body 12 and are mounted on inner core 14. The guide vanes 16 may have any desired shape and configuration, though guide vanes 16 are generally oriented and shaped to optimize passage of fluid through the interior of hollow body 12. As shown in the cross-sectional view of FIG. 2A, taken along line 2A—2A, the guide vane 16 takes the form of a pair of vanes oriented orthogonally to one another. This orientation is chosen for stability as fluid passes over and around the guide vane 16. However, guide vane 16 may take any desired shape, depending upon the needs and desires of the user. Further, as shown in FIG. 1A, the individual vanes of guide vane 16 may each have a contour resembling an airfoil in order to minimize drag as the craft passes through water.

Figure 2A:
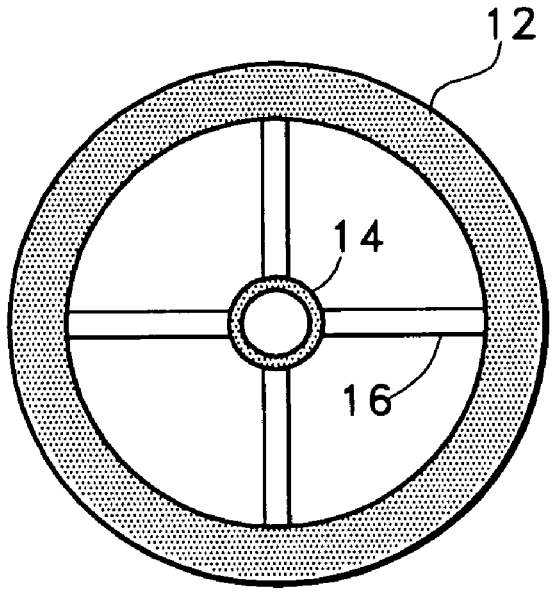
FIG. 2A shows a cross-sectional view of the subject submersible craft for water purification taken along cross-sectional view line 2A—2A of FIG. 1B.
Figure 2B:
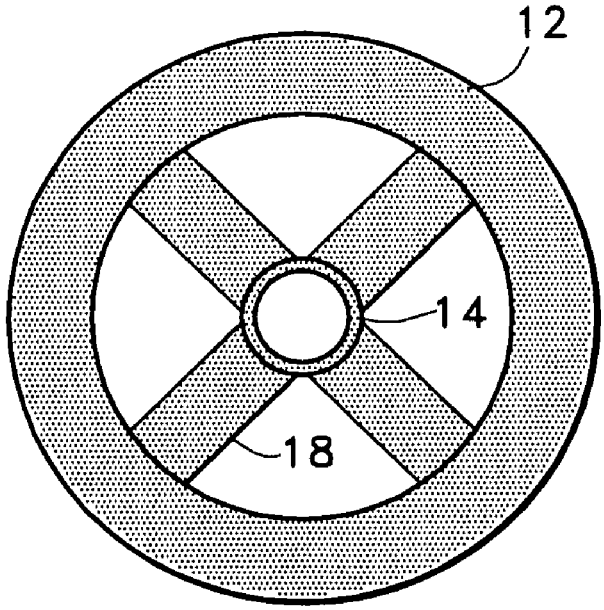
FIG. 2B shows a cross-sectional view of the subject submersible craft for water purification taken along cross-sectional view line 2B—2B of FIG. 1B.

A plurality of filter elements 18 are mounted on inner core 14 and are positioned within hollow body 12. FIG. 2B shows a cross-sectional view of the filter 18 taken along line 2B—2B, which resembles the shape and orientation of guide vanes 16, however it should be understood that the filter element may take any desired shape and orientation depending on the needs of the user. Filter elements 18 are removable and replaceable.

Figure 2C:
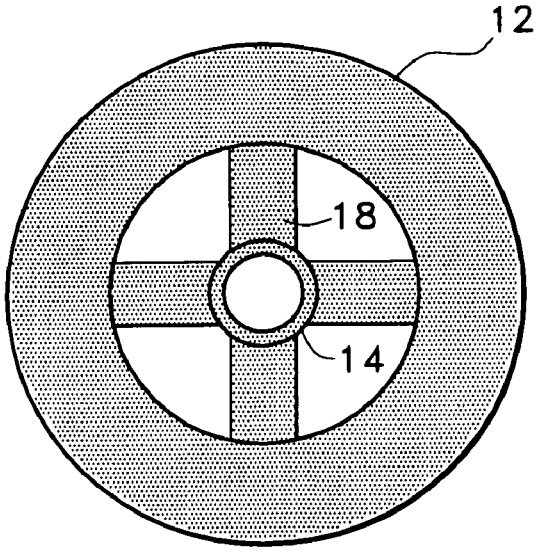
FIG. 2C shows a cross-sectional view of the subject submersible craft for water purification taken along cross-sectional view line 2C—2C of FIG. 1B.

Filters 18 are provided for the filtering and removal of contaminants from a body of water, such as an ocean, lake, swimming pool, reservoir or the like. The filter elements are selected by the user depending on the particular type of contaminant to be removed from the body of water. For example, filter elements 18 made of hydrophobic membrane materials may be used to filter out sun tan or bathing oils. As another example, filters formed of granular activated carbon (GAC) may be used to filter methyl tert-butyl ether (MTBE), a common pollutant in public waterways. FIG. 2C provides a cross-sectional view of a second filter element 18 mounted within hollow body 12.

Figure 2D:
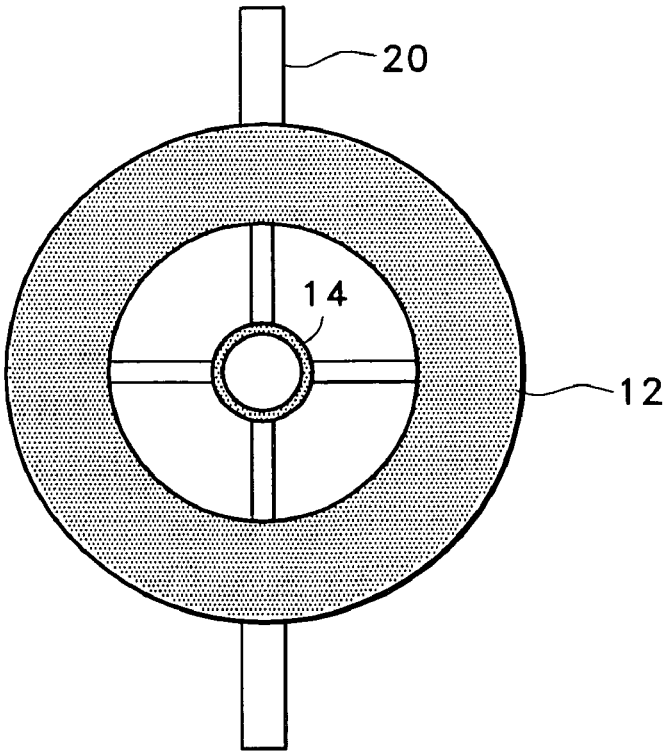
FIG. 2D shows a cross-sectional view of the subject submersible craft for water purification taken along cross-sectional view line 2D—2D of FIG. 1B.

Mounted exterior to the hollow body member 12 are a pair of guide wings 20. Wings 20 are conventional submarine guide wings and are shown as having a substantially airfoil-type contour, though the wings may be sized and shaped as required by the user and as dependent upon the specific fluid medium in which craft 10 is submerged. Guide wings 20 provide for navigation, stability and support as the craft 10 passes through the body of water. FIG. 2D shows a cross-sectional view of wings 20 mounted on body 12, taken along line 2D—2D.

In the embodiment of FIGS. 1A and 1B, an elevator 24 is further provided, allowing for control over depth of the submarine within the water. Elevator 24 is pivotally mounted to the exterior of hollow body 12 and is selectively controlled by servo-actuators 22, also mounted to the exterior of hollow body 12. As will be described below, servo-actuators 22 are controlled by the user, either through remote control or through a pre-programmed guidance system.

Figure 2E:
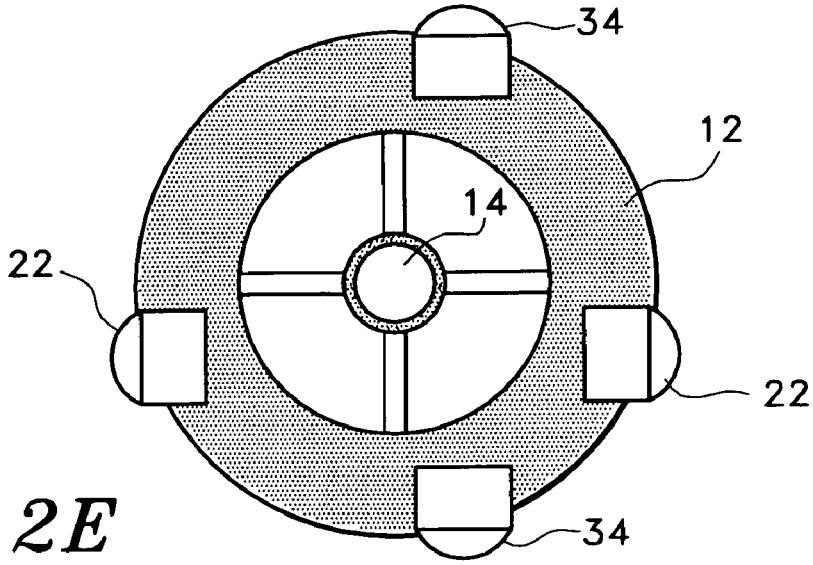
FIG. 2E shows a cross-sectional view of the subject submersible craft for water purification taken along cross-sectional view line 2E—2E of FIG. 1B.

A second pair of servo-actuators 34 are mounted to the exterior of hollow body member 12 for selective control of rudder 32, shown best in FIG. 3. As with servo-actuators 22, the servo-actuators 34 are controlled by the user for selective navigational control over the submarine 10. FIG. 2E shows both pairs of servo-actuators 22, 34 mounted on body 12, taken along cross-sectional view 2E—2E.

Figure 2F:
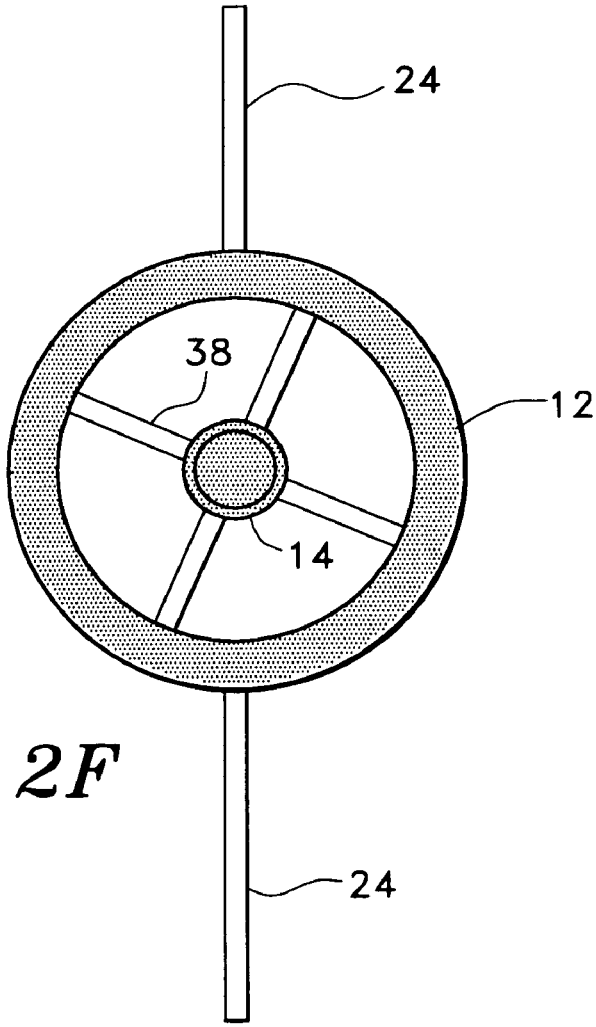
FIG. 2F shows a cross-sectional view of the subject submersible craft for water purification taken along cross-sectional view line 2F—2F of FIG. 1B.

The drive system, providing power for servo-actuators 22 and 34, and further providing propulsive power for the submarine, includes motor 28 mounted on a rear end of inner core 14. As shown in FIG. 1B, motor 28 is powered by a plurality of batteries 26 in communication with motor 28 via internal wire 30, mounted within the inner core 14. Batteries 26 may be rechargeable batteries, recharged by solar panels mounted external to the submersible craft (not shown) or by an external power adaptor. Batteries 26 may further be removable and replaceable, depending on the needs of the user. Motor 28 is in communication with propeller 38 for providing driving power to the same. As with navigation, the power produced by motor 28 and, thusly, the thrust provided to the craft 10, is selectively controlled by the user. FIG. 2F provides a cross-sectional view taken along line 2F—2F, showing the orientation of elevator 24 and propeller 38 with respect to hollow body member 12.

Figure 4:
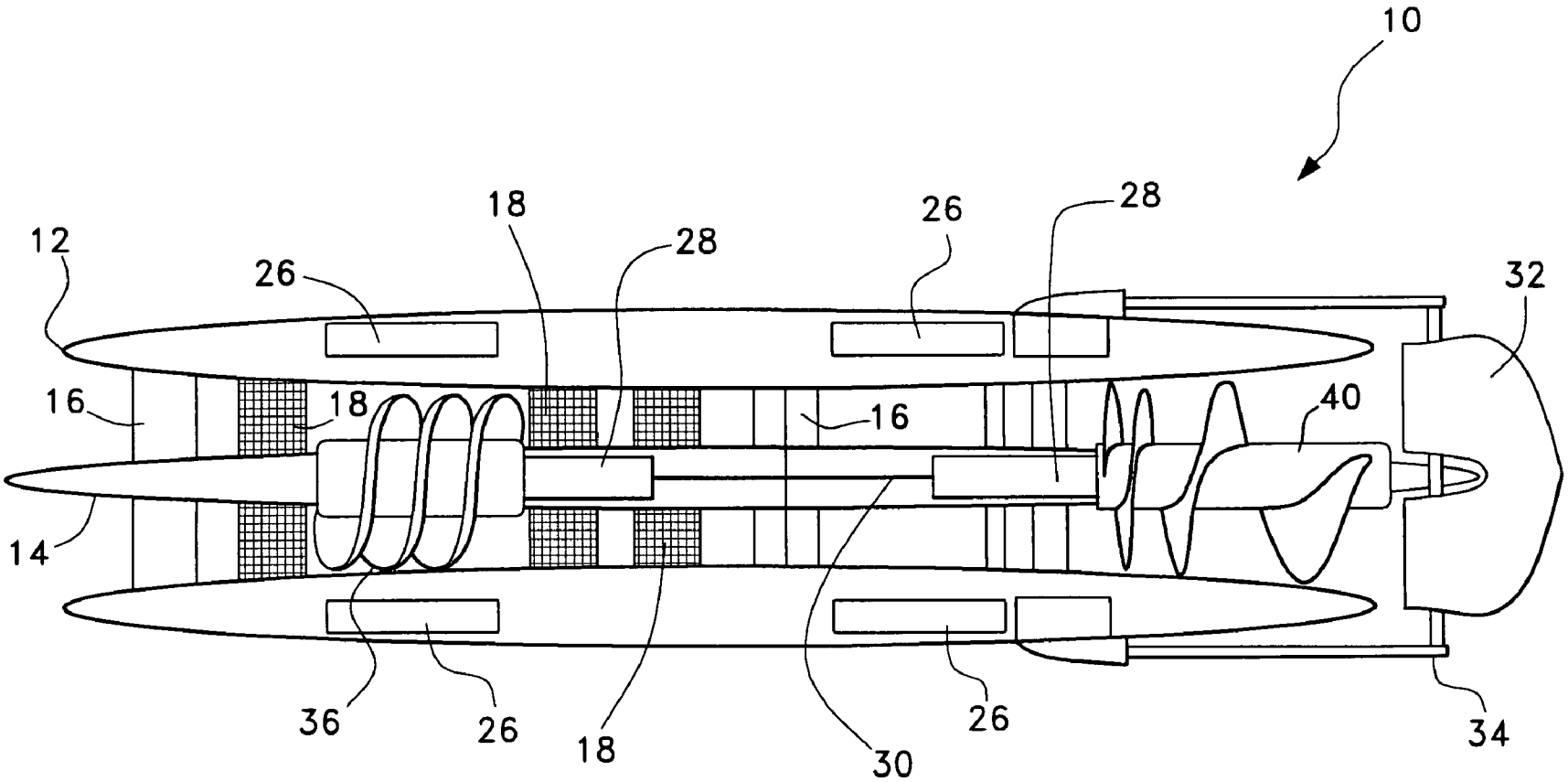
FIG. 4 shows a diagrammatic sectional view of an alternative embodiment of the subject submersible craft for water purification.

In the embodiment of FIG. 4, a screw-type propeller 36 is provided towards the front end of submersible craft 10, acting as a pump for the fluid entering and passing through the interior of hollow body member 12. Though the propulsion of craft 10 naturally forces water into the interior of hollow body 12, the addition of a pump increases the rate of water filtration and also provides for extra thrust. The screw-type propeller 36 may be powered by a second motor 28 positioned adjacent the screw-type propeller 36, with both being mounted on a front end of the main core 14.

Also shown in the embodiment of FIG. 4 is a spiral ribbon-type propeller 40 taking the place of the conventional propeller 38 of the embodiment shown in FIG. 3. The ribbon-type propeller 40 provides enhanced thrust and also provides for optimal fluid flow, reducing drag and unwanted vortices and other detrimental fluid currents. The ribbon-type propeller 40 further provides pumping action to draw water in, similar to that described above with reference to screw propeller 36.

Figure 5:
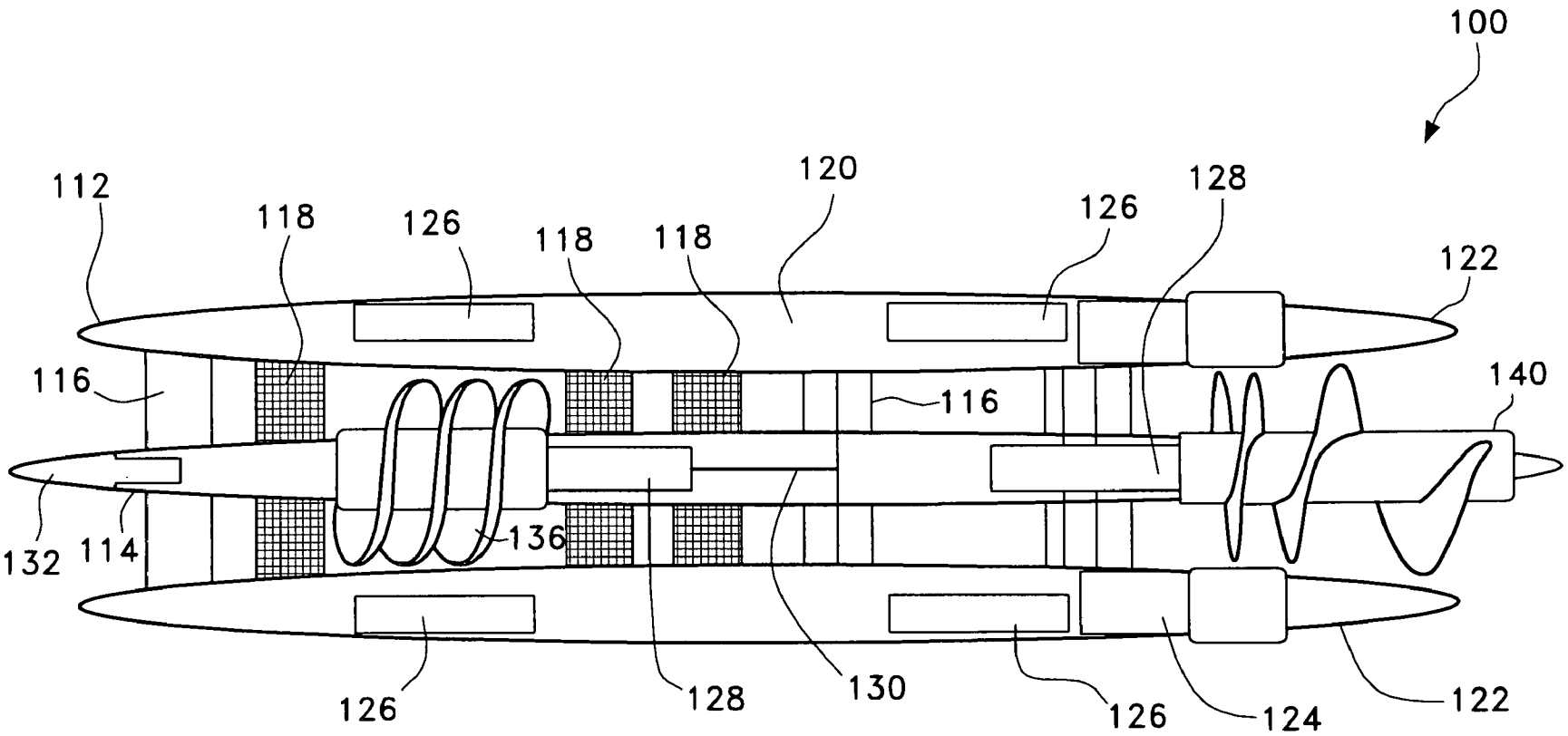
FIG. 5 shows a diagrammatic sectional view of another alternative embodiment of the subject submersible craft for water purification.
Figure 6:
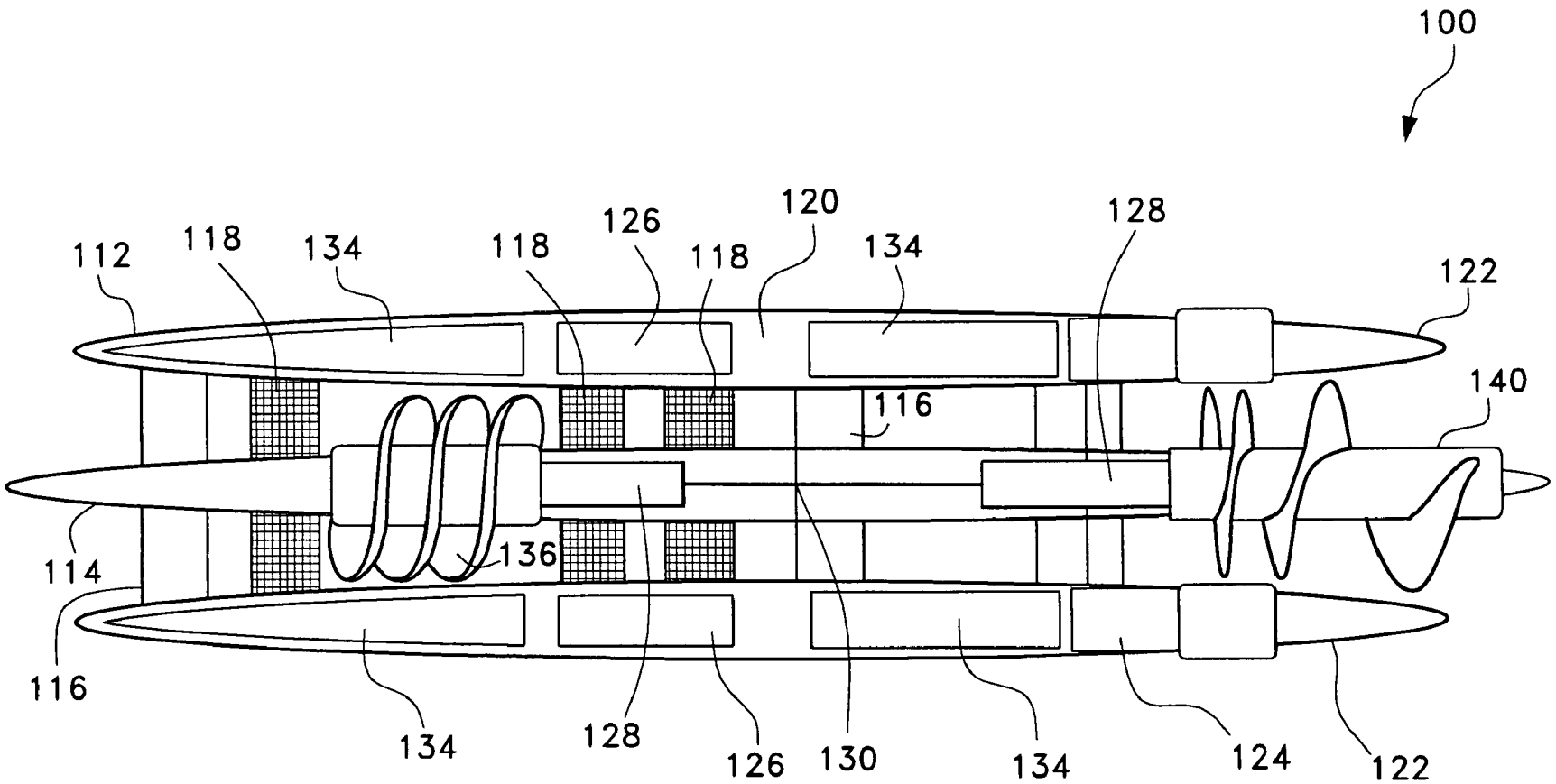
FIG. 6 shows a diagrammatic sectional view of another alternative embodiment of the subject submersible craft for water purification.

FIGS. 5 and 6 illustrate an alternative embodiment of the submersible craft for water purification 100. Main hollow body member 112 includes a front portion 120 and a rear portion 122. Rear portion 122 is pivotally secured to front portion 120 so that rear portion 122 may be rotated. Rather than utilizing a rudder, as in the embodiments of FIGS. 1A, 1B, 3 and 4, the rear portion 122, which houses propeller 140, rotates, thus providing for steering and navigational control of the craft 100. Rotation of rear portion 122 is powered by drive motor 128, which is controlled by the user, as will described in further detail below.

Craft 100 includes a main core 114, guide vanes 116 and filter elements 118, both mounted on the main core 114, and a plurality of batteries 126, similar to the corresponding elements in the embodiments of FIGS. 1A, 1B, 3 and 4. Screw-type propeller 136 is provided, acting as a water pump, as is propeller 140, and both are driven by motors 128, mounted on main core 114. Motors 128 are powered by batteries 126, which feed power to the motors via internal wire 130, positioned within main core 114. It should be noted that because the submersible craft is designed to operate in a water environment, the water is used to cool motors 128 and the other mechanical components. No separate cooling mechanism is required, thus increasing efficiency and minimizing the production of pollutants.

In the embodiment of FIG. 5, a remote control unit 124 is provided. The remote control unit 124 is in electrical communication with both the drive and navigational systems, allowing a user to remotely control the thrust, steering, navigation and depth of the craft 100. The remote control unit may be radio controlled, with an RF link between craft 100 and the user.

Additionally, an auxiliary monitoring and control module 132 may be mounted on the front end of the main core 114. The auxiliary monitoring and control module 132 may contain a camera, lighting, a contamination sensor and other equipment useful in the monitoring and analysis of the water for contaminants. Further the module 132 may contain a pre-programmed guidance system, thus allowing a user to program navigational and drive information prior to the launching of craft 100.

In yet another embodiment, shown in FIG. 6, controllable buoyancy tanks 134 are mounted within hollow body 112. These tanks may be controlled by the user to increase or decrease the buoyancy of the craft, thus controlling depth of the craft 100 within the body of water. Buoyancy tanks 134 take the place of elevator 24 in the embodiment shown in FIGS. 1A, 1B, 2A–2F, 3 and 4. It should be noted that the submersible craft utilizes the natural buoyancy of the craft materials and gravity in order to control depth, thus reducing power consumption and pollution production. The variable ballast produced by the buoyancy tanks is user-controlled, either through remote control units 124, or through the pre-programmed on-board navigational guidance system within auxiliary module 132, shown in FIG. 5.

It has been noted above that motors 28, 128 are, respectively, powered by electric batteries 26, 126. The use of electric motors for powering the crafts 10, 100 allows for usage of the craft in a body of water without increasing the level of pollutants already contained within the water.

It is to be understood that the present invention is not limited to the embodiments described above, but encompasses any and all embodiments within the scope of the following claims.

We claim:

1. A submersible craft for water purification comprising:

a hollow body member;

a plurality of filter elements received within said hollow body member for removal of contaminants from a fluid medium;

drive means for propelling said submersible craft through said fluid medium, said drive means being housed within said hollow body member;

at least one battery for powering said drive means, said at least one battery being mounted within said hollow body member; and, navigational means for controlling depth and steering of said submersible craft within said fluid medium, said navigational means including at least one buoyancy tank mounted within said hollow body member for selectively controlling depth of said submersible craft in said fluid medium;

whereby a user directs said submersible craft through said fluid medium in order to filter out said contaminants from said fluid medium.

2. The submersible craft for water purification as recited in claim 1, wherein said hollow body member has a substantially annular cross-sectional contour.

3. The submersible craft for water purification as recited in claim 1 further comprising at least one guide vane mounted within said hollow body member for directing fluid flow through said hollow body member as said submersible craft is directed through said fluid medium.

4. The submersible craft for water purification as recited in claim 1, wherein said drive means comprises:

a motor; and, a propeller driven by said motor.

5. The submersible craft for water purification as recited in claim 4 wherein said propeller is a spiral-ribbon propeller.

6. The submersible craft for water purification as recited in claim 4 further comprising a rotary screw pump driven by said motor for driving fluid through said plurality of filter elements and for increasing thrust through said fluid medium.

7. The submersible craft for water purification as recited in claim 1 wherein said navigational means include a pair of main wings projecting from an exterior surface of said hollow body member and mounted substantially centrally thereon.

8. The submersible craft for water purification as recited in claim 7 wherein said navigational means further comprise a selectively controllable rudder mounted on a rear end of said hollow body member.

9. The submersible craft for water purification as recited in claim 7 wherein said navigational means further comprise a selectively controllable elevator for controlling depth of said submersible craft.

10. The submersible craft for water purification as recited in claim 1 wherein said hollow body member includes a main body portion and a controllable swivel portion pivotally mounted on a rear end of said main body portion, said controllable swivel portion being coupled to said drive means and said navigational means for selectively controlling steering of said submersible craft through said fluid medium.

11. The submersible craft for water purification as recited in claim 1 wherein a remote control unit is mounted within said hollow body member, said remote control unit being in electrical communication with said drive means and said navigational means.

12. The submersible craft for water purification as recited in claim 1 further comprising a camera for visually monitoring purity of said fluid medium.

13. The submersible craft for water purification as recited in claim 1 further comprising a purity sensor for monitoring purity of said fluid medium.

14. The submersible craft for water purification as recited in claim 1 further comprising a guidance control unit mounted within said hollow body member for providing pre-programmed navigational control to said submersible craft for water purification, said guidance control unit being in electrical communication with said navigational means.

15. The submersible craft for water purification as recited in claim 1 further comprising an elongated core element received within said hollow body member and positioned along the longitudinal axis of said hollow body member, said plurality of filter elements and said drive means being mounted on said elongated core element.

16. A submersible craft for water purification comprising:

a hollow body member;

a plurality of filter elements received within said hollow body member for removal of contaminants from a fluid medium;

drive means for propelling said submersible craft through said fluid medium, said drive means being housed within said hollow body member;

a purity sensor for monitoring purity of said fluid medium;

at least one battery for powering said drive means, said at least one battery being mounted within said hollow body member; and, navigational means for controlling depth and steering of said submersible craft within said fluid medium, whereby a user directs said submersible craft through said fluid medium in order to filter out said contaminants from said fluid medium.

17. A submersible craft for water purification comprising:

a hollow body member;

a plurality of filter elements received within said hollow body member for removal of contaminants from a fluid medium;

drive means for propelling said submersible craft through said fluid medium, said drive means being housed within said hollow body member;

at least one battery for powering said drive means, said at least one battery being mounted within said hollow body member;

navigational means for controlling depth and steering of said submersible craft within said fluid medium; and, a guidance control unit mounted within said hollow body member for providing pre-programmed navigational control to said submersible craft for water purification, said guidance control unit being in electrical communication with said navigational means, whereby a user directs said submersible craft through said fluid medium in order to filter out said contaminants from said fluid medium.

* * * * *